US007473506B2

(12) United States Patent
Yahagi

(10) Patent No.: US 7,473,506 B2
(45) Date of Patent: Jan. 6, 2009

(54) METHOD OF PRODUCING AN ELECTROPHOTOGRAPHIC PHOTOCONDUCTOR AND AN ELECTROPHOTOGRAPHIC PHOTOCONDUCTOR PRODUCED BY THIS METHOD

(75) Inventor: Hidetaka Yahagi, Nagano (JP)

(73) Assignee: Fuji Electric Device Technology Co., Ltd., Tokyo (JP)

( * ) Notice: Subject to any disclaimer, the term of this patent is extended or adjusted under 35 U.S.C. 154(b) by 331 days.

(21) Appl. No.: 11/510,845

(22) Filed: Aug. 28, 2006

(65) Prior Publication Data

US 2007/0048641 A1 Mar. 1, 2007

(30) Foreign Application Priority Data

Aug. 26, 2005 (JP) ..... 2005-246485

(51) Int. Cl.
*G03G 15/04* (2006.01)

(52) U.S. Cl. ..... 430/69; 430/127

(58) Field of Classification Search ..... 430/69, 430/127

See application file for complete search history.

(56) References Cited

U.S. PATENT DOCUMENTS 6,080,491 A * 6/2000 Takaki et al. ..... 430/65

FOREIGN PATENT DOCUMENTS

| | | |
|---|---|---|
| JP | 63-179037 | 7/1988 |
| JP | 63-179038 | 7/1988 |
| JP | 63-300277 | 12/1988 |
| JP | 1-285953 | 11/1989 |
| JP | 03-122239 | 5/1991 |
| JP | 03-236060 | 10/1991 |
| JP | 6-236059 | 8/1994 |
| JP | 6-324500 | 11/1994 |
| JP | 7-234531 | 9/1995 |
| JP | 08-278652 | 10/1996 |
| JP | 9-197697 | 7/1997 |
| JP | 10-301312 | 11/1998 |
| JP | 2000-66428 | 3/2000 |

* cited by examiner

*Primary Examiner*—Mark A Chapman
(74) *Attorney, Agent, or Firm*—Rabin & Berdo, PC

(57) ABSTRACT

A method of producing an electrophotographic photoconductor, which prevents filler material in a coating liquid from aggregating onto etching pits formed on a surface of an aluminum raw drum. A photoconductor produced by the method of invention scarcely generates printing defects. The method includes steps of cutting a surface of an aluminum cylindrical substrate, degreasing and cleaning the surface of the aluminum cylindrical substrate with an aqueous detergent after the cutting step, and applying and forming a coating layer containing a filler material on the aluminum cylindrical substrate after the degreasing and cleaning step. Nickel concentration in the aluminum cylindrical substrate used in the method of invention is at most 50 ppm by weight.

4 Claims, 16 Drawing Sheets

METHOD OF PRODUCING AN ELECTROPHOTOGRAPHIC PHOTOCONDUCTOR AND AN ELECTROPHOTOGRAPHIC PHOTOCONDUCTOR PRODUCED BY THIS METHOD

CROSS-REFERENCE TO RELATED APPLICATION

This application is based on, and claims priority to, Japanese Patent Application No. 2005-246485, filed on Aug. 26, 2005, the contents of which are incorporated herein by reference.

BACKGROUND OF THE INVENTION

1. Field of the Invention

The present invention relates to a method of producing an electrophotographic photoconductor and an electrophotographic photoconductor produced by the method (also referred to simply as "photoconductor" and "production method"), in particular, to a method of producing an electrophotographic photoconductor mounted on electrophotographic apparatuses such as copiers, facsimile machines, and printers, and an electrophotographic photoconductor produced by this method.

2. Description of the Related Art

An electrophotographic photoconductor has a basic structure comprising a conductive cylindrical substrate and a photosensitive layer including a charge generation substance, a charge transport substance, and a resin binder formed on the substrate. A material primarily used for a cylindrical substrate of a photoconductor is an aluminum alloy, specifically of material code 6063 (prescribed in Japanese Industrial Standards) containing additives of silicon and magnesium, or 3003 containing additives of iron and manganese. The aluminum alloy is generally cast after the steps of welding, composition adjustment, and removing impurities such as oxides, and formed into a cylindrical shape by hot extrusion. Then, the aluminum cylinder is given improved dimensional accuracy by cold drawing and cut using a turning tool of sintered diamond to obtain a cylindrical substrate having desired dimensions (hereinafter referred to as a "raw drum").

In the cutting process, a mist of cutting oil (electrical discharge machining oil or kerosene) is sprayed onto the surface of the raw drum to cool the tip of the tool and control the direction of scattering of cut chips. As a result, a large quantity of the cutting oil adheres to the surface of the raw drum. Since a photoconductor is produced by coating this surface of the raw drum with a photosensitive layer, the cutting oil adhered to the drum in the cutting process must be removed in a cleaning process before a process of coating with the photosensitive layer.

There are known techniques for improving aluminum raw drums used in photoconductors. Japanese Unexamined Patent Publication No S63-300277 discloses a technique for obtaining a photoconductor drum exhibiting good electrical characteristics by using a photoconductor drum substrate composed of an aluminum alloy containing a specified quantity of nickel. Japanese Unexamined Patent Publication No. S63-179037 and Japanese Unexamined Patent Publication No. S63-179038 disclose techniques for obtaining an aluminum alloy cylinder exhibiting good surface smoothness by regulating iron content and nickel content, respectively, in the aluminum alloy. Japanese Unexamined Patent Publication No. H7-234531 discloses in paragraph [008] thereof that a conductive substrate composed of an aluminum alloy containing iron in a specified quantity suppresses the number of etching pits generated in the process of cleaning with weak alkaline detergent. Japanese Unexamined Patent Publication No. H6-236059 discloses a technique for obtaining a photoconductor with good image quality by using a conductive substrate produced by controlling the surface roughness in the processes of extrusion, drawing, and pressurized polishing.

In the above-mentioned step of cleaning a raw drum, chlorine-containing organic solvents have heretofore been used, represented by trichloroethylene, dichloromethane, and flon, which exhibit high polarity and strong dissolving ability. Use of these organic solvents was stopped recently because of heavy environmental loading. Instead, so-called aqueous cleaning agents such as neutral detergent and alkaline cleaning agents are being used.

However, problems that occur in the use of aqueous cleaning agents, but not in the process of cleaning with conventional organic solvents, have become apparent. Aluminum alloys primarily used in a raw drum contain inorganic additive elements of silicon and magnesium in order to facilitate cutting, so the aluminum alloys include crystallized deposits or precipitations of intermetallic compounds such as Mg—Si, Fe—Si, Fe—Al—Si or the like having a diameter of 5 to 20 μm. In an aqueous cleaning agent, aluminum around the crystallized deposits dissolves by etching, generating an etching pit. A study by the inventor has further clarified, as described later, that this etching occurs not only when dipping in high pH cleaning agents but also in pure water, resulting in the generation of etching pits.

In these etching pits, a small amount of cleaning agent used in a cleaning process or water used for rinsing the agent generally remains. A photosensitive layer normally comprises a CGL (charge generation layer) and a CTL (charge transport layer) sequentially applied and formed on a raw drum through a UCL (undercoat layer). After applying each layer, heated drying is conducted at a temperature in the range of 80 to 150° C. to dry the applied layer. The undercoat layer often contains filler material of $TiO_2$ inorganic pigment dispersed in the layer. In such a case, due to the water component or the like remaining in an etching pit, aggregation 14 of filler material 13 in the coating liquid 12 of undercoat layer occurs in the etching pit 11 as shown in FIG. 7. It has been clarified that this aggregation causes a printing defect, which is fatal to a photoconductor. The symbol 15 in FIG. 7 indicates a crystallized deposit in the aluminum alloy.

SUMMARY OF THE INVENTION

In light of the above-described problems in the prior art, an object of the present invention is to provide a method of producing an electrophotographic photoconductor in which filler material in a coating liquid is prevented from aggregating in an etching pit formed on a surface of the aluminum raw drum, and a printing defect does not occur. Another object of the invention is to provide an electrophotographic photoconductor produced by such a method.

The inventor of the present invention has done extensive studies including analysis of etching pits on the surface of a raw drum corresponding to defects on a photosensitive layer, and found that occurrence of defects closely relates to the composition of the intermetallic compound of the etching pit.

The study has revealed that the cleaning agent or water is apt to remain in an etching pit formed in the cleaning process when the intermetallic compound of the etching pit contains more than a certain amount of nickel. To clarify a scientific reason for this phenomenon, the inventor analyzed the cross-sectional structure of the etching pit using an FIB (focused ion beam), and found that an etching pit with an intermetallic compound that does not contain more than a certain amount of nickel has a simple hemispherical shape (FIGS. 8A and 8B) while an etching pit with an intermetallic compound that contains more than this amount of nickel has a rather complicated shape that allows water or the like used in a cleaning process to remain in the pit (FIGS. 9A and 9B). The inventor analyzed the nickel concentration (the proportion of nickel by weight) by means of emission spectral analysis, and found that nickel is detected in an etching pit and defects occur when the aluminum raw drum contains nickel in an amount larger than about 50 ppm (parts per million). The present invention has been accomplished based on these findings.

The production method of the invention is a method of producing an electrophotographic photoconductor including the steps of cutting a surface of an aluminum cylindrical substrate, degreasing and cleaning the surface of the aluminum cylindrical substrate with an aqueous cleaning agent after the cutting step, and applying and forming a coating layer containing a filler material on the aluminum cylindrical substrate after the degreasing and cleaning step, where the nickel concentration in the aluminum cylindrical substrate is no more than 50 ppm by weight.

The electrophotographic photoconductor of the invention is an electrophotographic photoconductor produced by the production method of the invention.

Concerning nickel concentration in an aluminum cylindrical substrate for electrophotography, Japanese Unexamined Patent Publication No. H1-285953 states that a nickel concentration of up to 0.02% (200 ppm) does not cause imaging defects and thus is permitted. However, the permissible nickel content depends on the coating material applied on the cylindrical substrate. In the case of a coating liquid dispersing filler material such as $TiO_2$, the nickel concentration must be controlled to at most 50 ppm.

Regarding chemical composition in an aluminum cylindrical substrate for electrophotography, more particularly regulation of impurities such as iron content, there exist descriptions in Japanese Unexamined Patent Publication No. 2000-66428, Japanese Unexamined Patent Publication No. H10-301312, Japanese Unexamined Patent Publication No. H9-197697, and Japanese Unexamined Patent Publication No. H6-324500. However, iron is not directly involved, but actually, a minute quantity of nickel accompanying the iron affects the sectional structure of etching pits or electrolytic pits formed in the cleaning process with an aqueous cleaning agent or anodization process. Thus, if only nickel concentration is controlled, the iron content need not be limited to the values taught by these documents.

The present invention featuring as described above has provided a method of producing an electrophotographic photoconductor in which filler material in a coating liquid is prevented from aggregating on an etching pit formed on a surface of an aluminum raw drum, and a printing defect does not occur. Such an electrophotographic photoconductor has also been provided.

Preferred embodiments according to the invention will be described below in detail with reference to the accompanying drawings in which like numerals refer to like elements.

DETAILED DESCRIPTION OF THE INVENTION

Figure 1:
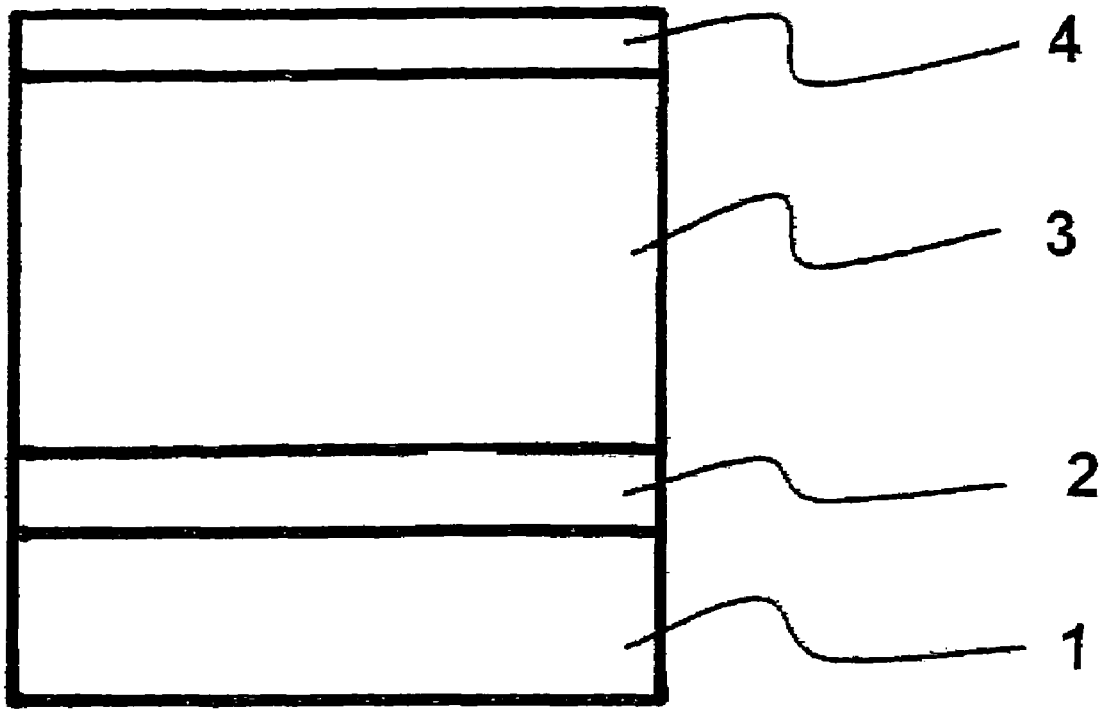
FIG. 1 is a schematic sectional view illustrating a common structure of an electrophotographic photoconductor.

FIG. 1 is a schematic sectional view of a photoconductor of an embodiment according to the invention. In FIG. 1, the symbol 1 represents a conductive substrate, 2: an undercoat layer, 3: a photosensitive layer, 4: a protective layer. An undercoat layer 2 and a protective layer 4 are provided as necessary. A photosensitive layer 3 can be a single layer type consisting of a single layer having both functions of charge generation and charge transport, or a functionally separated type consisting of two laminated functionally separated layers of a charge generation layer and a charge transport layer.

Figure 2:
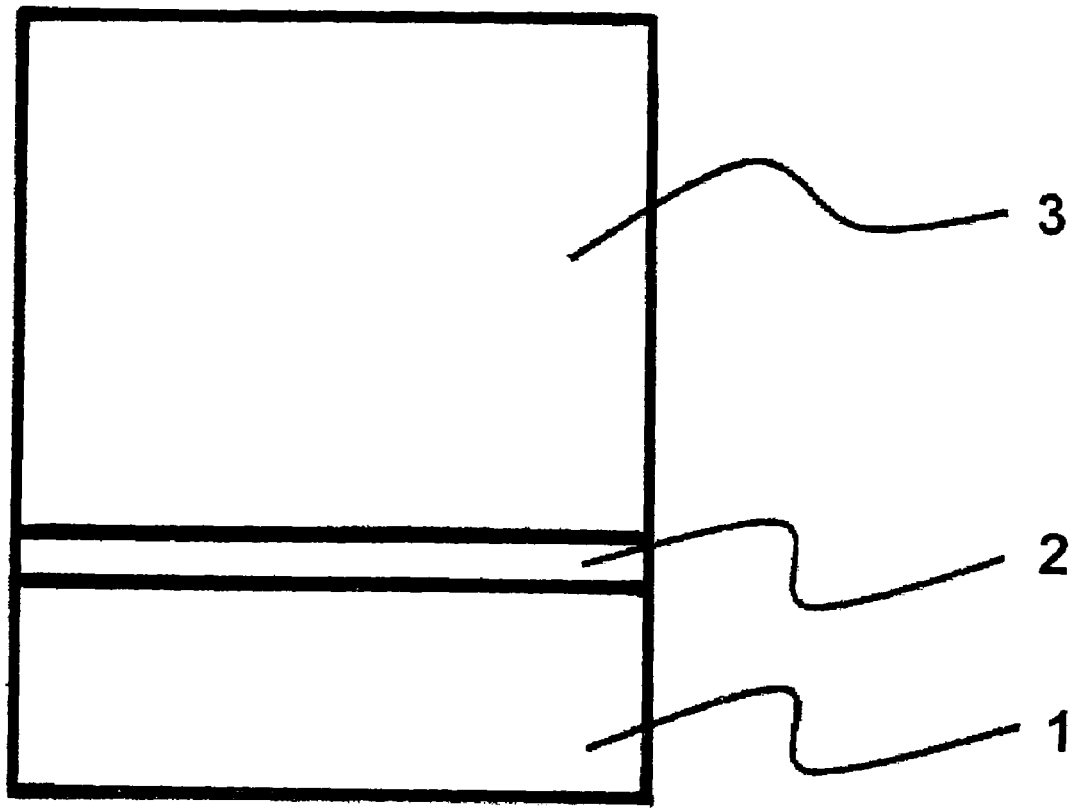
FIG. 2 is a schematic sectional view illustrating an example of a structure of a single layer electrophotographic photoconductor.
Figure 3:
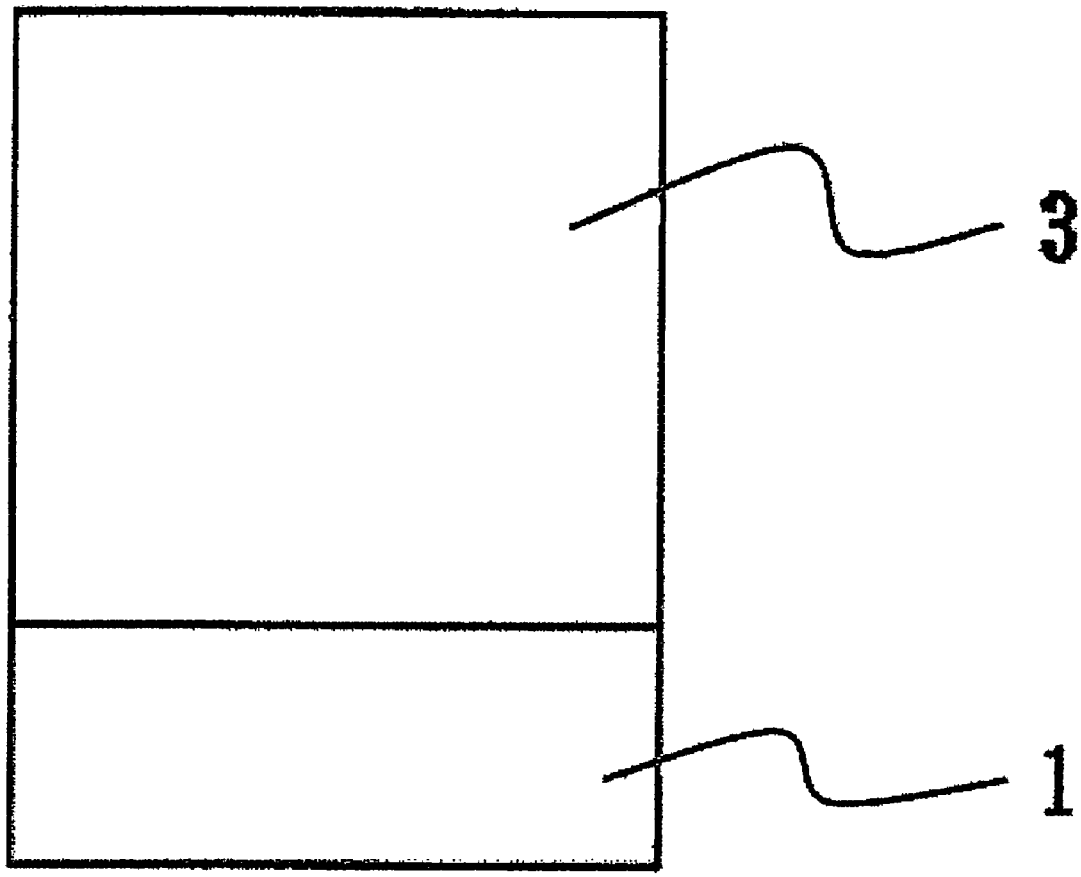
FIG. 3 is a schematic sectional view illustrating another example of a structure of a single layer electrophotographic photoconductor.
Figure 4:
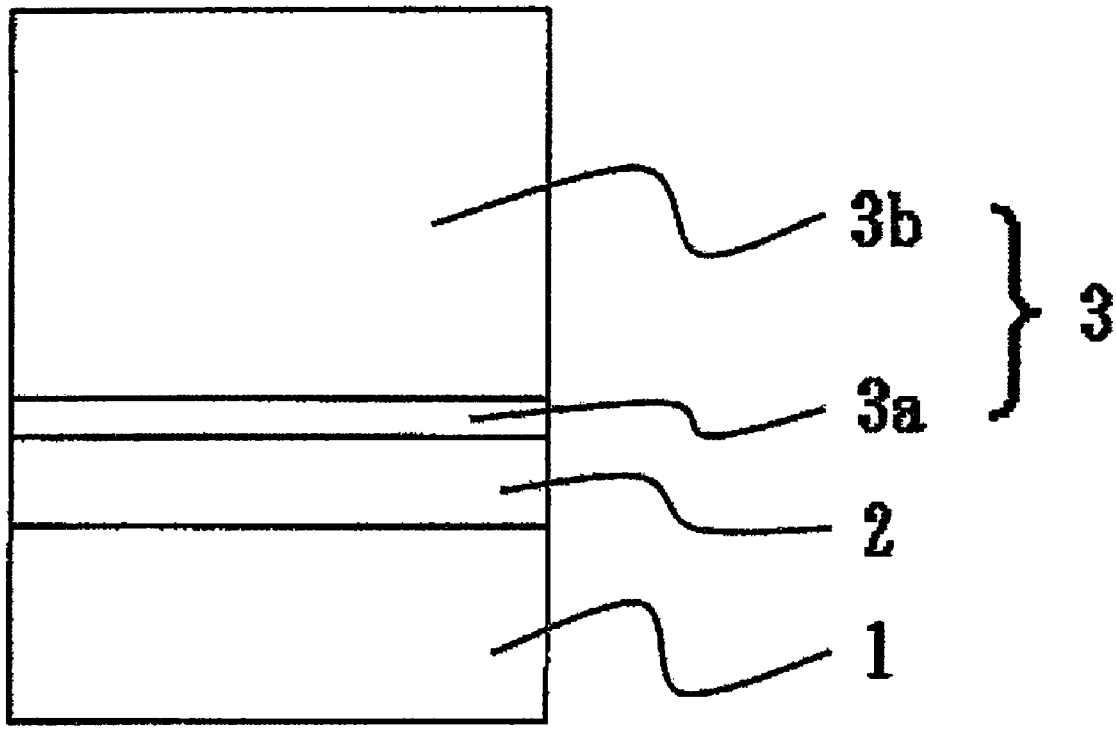
FIG. 4 is a schematic sectional view illustrating an example of a structure of a multilayer electrophotographic photoconductor.
Figure 5:
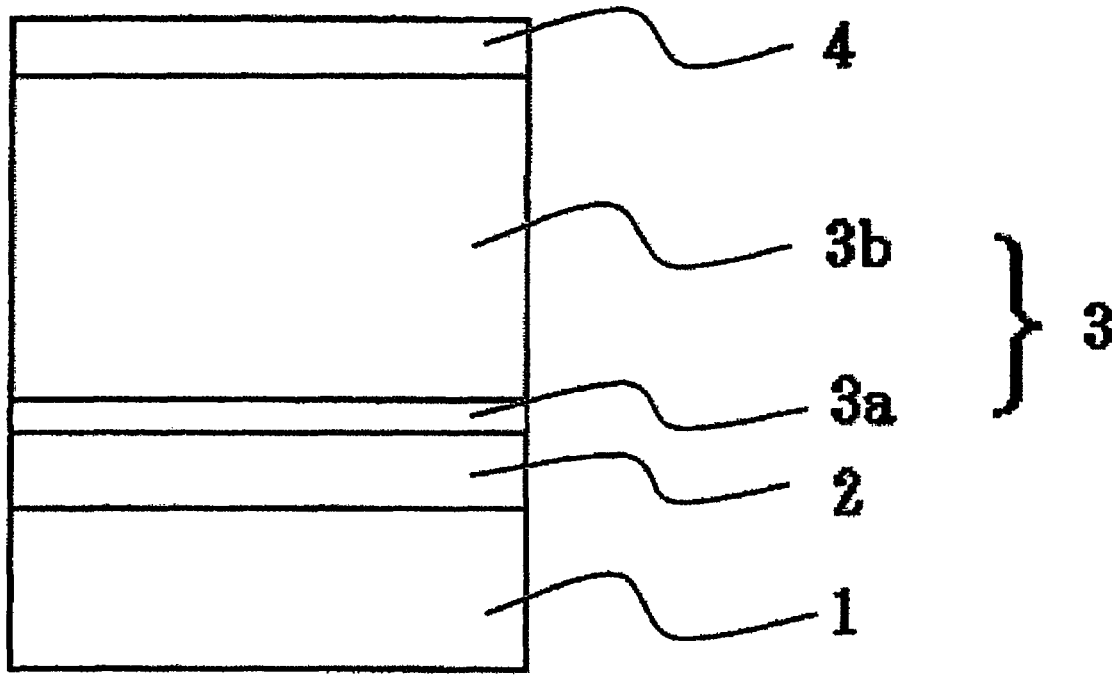
FIG. 5 is a schematic sectional view illustrating another example of a structure of a multilayer electrophotographic photoconductor.
Figure 6:
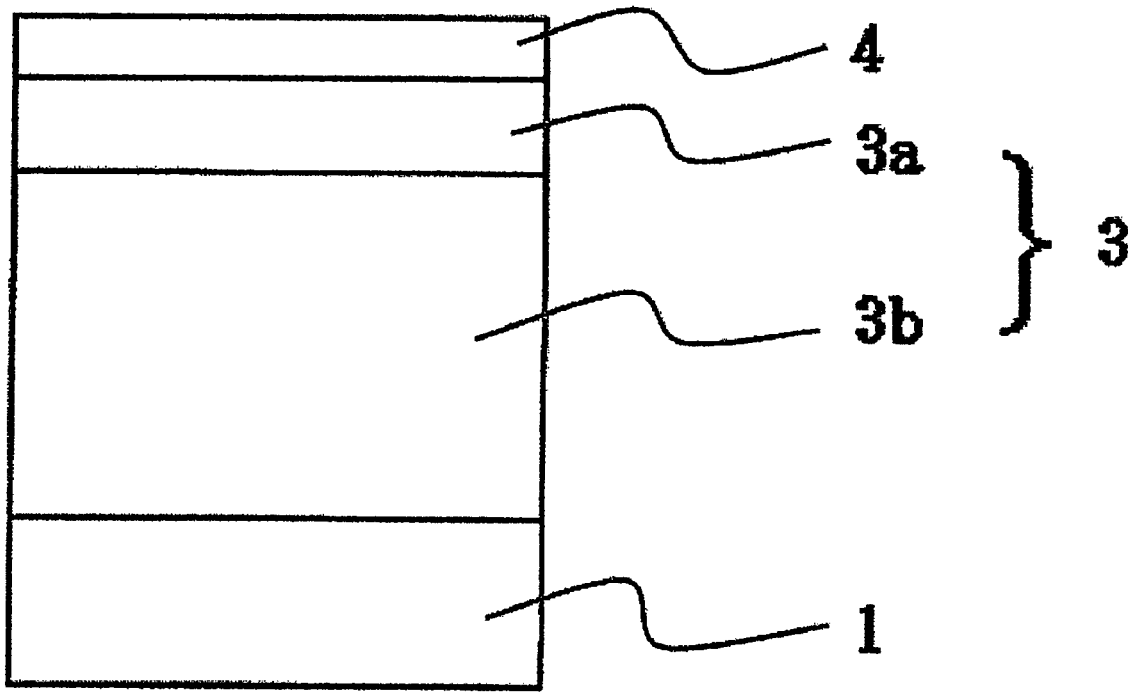
FIG. 6 is a schematic sectional view illustrating still another example of a structure of a multilayer electrophotographic photoconductor.

Photoconductors have basic layer structures shown in FIG. 2 through 6. FIG. 2 and FIG. 3 show single layer type photoconductors having a photosensitive layer 3 of a single layer type. FIG. 4 and FIG. 5 show functionally separated lamination type photoconductors having a photosensitive layer 3 formed by laminating sequentially a charge generation layer 3*a* and a charge transport layer 3*b* on an undercoat layer 2. FIG. 6 shows a functionally separated lamination type photoconductor having a protective layer 4 formed on a photosensitive layer 3 that is formed by laminating sequentially a charge transport layer 3*b* and a charge generation layer 3*a*. The present invention, however, shall not be limited to the photoconductors having layer structures shown in FIG. 2 through 6.

A conductive substrate 1 works as an electrode of the photoconductor and, at the same time, as a support member for other layers. A conductive substrate of a photoconductor according to the invention necessarily uses a raw drum of an aluminum alloy containing nickel in proportions of no more than 50 ppm by weight. This measure prevents filler material in a coating liquid from aggregating in an etching pit formed on the surface in a step in producing a photoconductor, as described later, and thus provides a photoconductor free of printing defects.

Measurement of the nickel concentration in an aluminum alloy can be carried out as follows.

(1) About 1.0 g is sampled from an aluminum alloy specimen. (Or sampled from a specimen with its surface degreased using ethanol.)

(2) The sampled piece is degreased and cleaned with ethanol, and after drying in a desiccator for at least 4 hours, weighed by a precision balance that can measure to five decimal places.

(3) Fifteen milliliters of mixed liquid of hydrochloric acid and nitric acid (1:1) is added to the piece of sample in an evaporating dish made of Teflon (trade mark), and the dish is covered by a watch glass and heated by a hot plate set at 100° C. for about 1 hour to dissolve the sample.

(4) After leaving the sample to cool, drops of the liquid adhered on the watch glass are washed down into a container made of Teflon (trade mark) with ultra pure water (≧18.2 MΩ–cm), and 1 ml of hydrofluoric acid is added to dissolve the remained component thoroughly.

(5) The solution of the dissolved sample is transferred to a 100 ml measuring flask. The Teflon container is rinsed several times with ultra pure water, and the water is also put into the flask.

(6) The volume of the liquid in the measuring flask is adjusted to 100 ml by adding ultra pure water, to obtain liquid for analysis.

(7) The nickel concentration of the analysis liquid is analyzed by a calibration curve method using an ICP (inductively coupled plasma) emission spectroscopy apparatus, for example, JY138-ULTRACE, a product of Rigaku Corporation. (Wavelength in the nickel concentration measurement=231.604 nm)

(8) From the result of the ICP analysis ("A" ppm=(mgl)=×$10^{-6}$ mg/mg), the weight of the sample piece ("B" g=×1,000 mg), and the specified volume ("C" ml=×1,000 mg), a proportion in the specimen ("D" ppm) is obtained by the equation:

$$D=A\times C/B$$

For example, when A=0.5 ppm, B=1.0 g, and C=100 ml, then D (ppm)=0.5×100/1.0=50 ppm.

(9) Preparation of standard liquid:

A calibration curve is made based on a standard liquid and ultra pure water (=0 ppm), concentrations of which locate at both sides of a result of an ICP analysis.

Preparation of 1.0 ppm Standard Liquid:

0.1 ml of nickel standard liquid for atomic absorption spectroscopy (produced by Kanto Chemical Co., Ltd., 1,003 mg/l=ppm) is measured out into a 100 ml flask; 15 ml of mixed solution of hydrochloric acid and nitric acid in the ratio of one to one and 1 ml of hydrofluoric acid are added into the flask; and ultra pure water is added to adjust to 100 ml.

Preparation of 0.1 ppm Standard Liquid:

10 ml of the 1.0 ppm adjusted standard liquid prepared above is measured out into a 100 ml flask; 13.5 ml of mixed solution of hydrochloric acid and nitric acid in the ratio of one to one and 0.9 ml of hydrofluoric acid are added into the flask; and ultra pure water is added to adjust to 100 ml.

An undercoat layer 2 is provided as necessary for the purpose of preventing excessive charges from entering into the photosensitive layer from the conductive substrate, covering defects on the substrate surface, and improving adhesiveness of the photosensitive layer. The undercoat layer 2 is mainly composed of resin.

A resin binder for the undercoat layer can be selected from polycarbonate resin, polyester resin, poly(vinyl acetal) resin, poly(vinyl butyral) resin, vinyl chloride resin, vinyl acetate resin, polyethylene, polypropylene, polystyrene, acrylic resin, polyurethane resin, epoxy resin, melamine resin, phenolic resin, silicone resin, polyamide resin, polystylene resin, polyacetal resin, polyallylate resin, polysulfone resin, polymethacrylate, and copolymers of these substances, and appropriate combinations of these materials.

The resin binder in the invention contains one or more types of filler material selected from metal oxides such as silicon oxide (silica), titanium oxide, zinc oxide, calcium oxide, aluminum oxide (alumina), and zirconium oxide, metal sulfates such as barium sulfate and calcium sulfate, metal nitrides such as silicon nitride and aluminum nitride. A preferred material is titanium oxide. The surface of the fine particles can be subjected to surface treatment with silane coupling agent or covered with a metal oxide film.

The thickness of the undercoat layer depends on the composition of the undercoat layer and is set to an appropriate value so that undesirable effects such as an increase in stored potential do not occur in repeated continuous operation. Generally, the thickness of the undercoat layer is in the range of 0.01 to 50 μm. The undercoat layer can be composed of plural laminated layers.

A photosensitive layer 3 is composed primarily of two layers, a charge generation layer 3*a* and a charge transport layer 3*b* in the case of a functionally separated type, and a single layer in the case of a single layer type. Plural layers that perform the same function can be laminated.

A charge generation layer 3*a*, having the function of generating charges upon receiving light, can be formed by vacuum evaporation of an inorganic or organic photoconductive substance or applying a material containing an inorganic or organic photoconductive substance dispersed in a resin binder. For the charge generation layer 3*a*, the ability to inject generated charges into the charge transport layer 3*b* is important as well as high charge generation efficiency. It is desired that satisfactory charge injection is possible with little electric field dependence and even at a low electric field.

A charge generation layer needs only a charge generation function. So, the thickness is determined by a light absorption coefficient of the charge generation substance, and is normally in the range of 0.1 to 50 μm. In the case of a laminated type photoconductor having a charge transport layer laminated on the charge generation layer, the thickness is not more than 5 μm, and preferably not more than 1 μm.

The charge generation layer is mainly composed of a charge generation substance. Charge transport substances or other additives can also be contained in the charge generation layer. A charge generation substance can be selected from phthalocyanine pigment, azo pigment, anthoanthrone pigment, perylene pigment, perynone pigment, squarilium pigment, thiapyrylium pigment, quinacridone pigment, and appropriate combinations of these substances. The content of the charge generation substance is in the range of 10 to 90 wt %, more preferably in the range of 20 to 80 wt % with respect to the solid component of the charge generation layer.

A resin binder for the charge generation layer can be selected from poly(vinyl acetal) resin, poly(vinyl butyral) resin, vinyl chloride resin, vinyl acetate resin, silicone resin, polycarbonate resin, polyester resin, polyethylene, polypropylene, polystylene, acrylic resin, polyurethane resin, epoxy resin, melamine resin, polyamide resin, polystylene resin, polyacetal resin, polyallylate resin, polysulfone resin, polymethacrylate, and copolymers of these substances, and appropriate combinations of these materials. Similar types of resins having different molecular weights can be used. Content of the charge generation substance is in the range of 10 to 90 wt %, preferably 20 to 80 wt % with respect to solid component of the charge generation layer.

A charge transport layer 3*b* is a coating film consisting of a resin binder and charge transport substance dispersed in the resin binder. The charge transport layer is an insulator and holds charges in the photoconductor in the dark, and functions to transport the charges injected from the charge generation layer upon receipt of light.

There are two types of charge transport substances: hole transport substances and electron transport substances. The content of the charge transport substance is in the range of 10 to 90 wt %, preferably 20 to 80 wt % with respect to the solid component of the charge transport layer.

An electron transport substance can be selected from known electron acceptor substances and electron transport substances including succinic anhydride, maleic anhydride, dibromosuccinic anhydride, phthalic anhydride, 3-nitro phthalic anhydride, 4-nitro phthalic anhydride, pyromellitic anhydride, pyromellitic acid, trimellitic acid, trimellitic anhydride, phthalimide, 4-nitro phthalimide, tetracyanoethylene, tetracyanoquinodimethane, chloranil, bromanil, o-nitrobenzoic acid, trinitrofluorenone, quinone, benzoquinone, diphenoquinone, naphthoquinone, anthraquinone, and stilbenequinone.

A hole transport substance can be selected from, e.g. styryl compounds, hydrazone compounds, pyrazoline compounds, pyrazolone compounds, oxadiazole compounds, oxazole compounds, arylamine compounds, benzidine compounds, stylbene compounds, poly(vinyl carbazole), polysilane. Combinations of two or more of these hole transport substances can also be used.

A resin binder for the charge transport layer can be selected from, e.g. polycarbonate resin, polyester resin, poly(vinyl acetal) resin, poly(vinyl butyral) resin, vinyl chloride resin, vinyl acetate resin, polyethylene, polypropylene, polystylene, acrylic resin, polyurethane resin, epoxy resin, melamine resin, phenolic resin, silicon-containing resin, silicone resin, polyamide resin, polystylene resin, polyacetal resin, polyallylate resin, polysulfone resin, polymethacrylate, and copolymers of these substances, and appropriate combinations of these materials. The content of the binder resin is in the range of 10 to 90 wt %, preferably in the range of 20 to 80 wt % with respect to the solid component of the charge transport layer.

The thickness of the charge transport layer is preferably in the range of 3 to 100 μm, more preferably in the range of 10 to 50 μm to hold a practically effective surface potential.

A functionally separated laminated photoconductor normally has a structure comprising a charge transport layer laminated on a charge generation layer. However, a structure is also possible in which a charge generation layer is laminated on a charge transport layer as shown in FIG. 6.

A single layer type photosensitive layer mainly consists of a charge generation substance, a charge transport substance and a resin binder. The charge transport substance can be the same compound as the charge transport substance used in the charge transport layer 3*b*, and is preferably a combination of an electron transport substance and hole transport substance. The charge generation substance in a single layer type photosensitive layer can be the same compound as the charge generation substance used in the charge generation layer 3*a*. The resin binder can also be the same compound as the resin binder used in the charge transport layer 3*b* and the charge generation layer 3*a*.

The content of the charge generation substance is in the range of 0.01 to 50 wt %, preferably in the range of 0.1 to 20 wt %, more preferably in the range of 0.5 to 10 wt % with respect to the solid component of the single layer photosensitive layer. The content of the charge transport substance is in the range of 10 to 90 wt %, preferably 20 to 80 wt % with respect to the solid component of the single layer photosensitive layer. Relative proportions by weight of the electron transport substance and the hole transport substance are in the range of 0:100 to 100:0, preferably 10:90 to 90:10, more preferably 20:80 to 80:20. The content of the resin binder is normally in the range of 10 to 90 wt %, preferably in the range of 20 to 80 wt % with respect to the solid component of the single layer type photosensitive layer.

The thickness of the single layer photosensitive layer is preferably in the range of 3 to 100 μm, more preferably in the range of 10 to 50 μm to hold a practically effective surface potential.

A photosensitive layer can contain an agent to prevent degradation such as an antioxidant or photo-stabilizing agent for the purpose of improving resistance to the environment and stability against harmful light. Compounds used for these purposes include chromanol derivatives such as tocopherol and esterified compounds, poly(aryl alkane) compounds, hydroquinone derivatives, etherified compounds, dietherified compounds, benzophenone derivatives, benzotriazole derivatives, thioether compounds, phenylene diamine derivatives, phosphonic ester, phosphite, phenol compounds, hindered phenol compounds, straight chain amine compounds, cyclic amine compounds, and hindered amine compounds.

A photosensitive layer can also contain a leveling agent such as silicone oil or fluorine containing oil for the purpose of giving improved leveling characteristics and lubrication ability.

The photosensitive layer can further contain a filler material for the purpose of reducing friction coefficient or giving lubricity. Such a filler material can be selected from fine particles of metal oxides such as silicon oxide (silica), titanium oxide, zinc oxide, calcium oxide, aluminum oxide (alumina), and zirconium oxide, metal sulfates such as barium sulfate and calcium sulfate, metal nitrides such as silicon nitride and aluminum nitride; or particles of fluorine-containing resin such as tetrafluoroethylene resin, fine particles of silicone resin, fluorine-containing polymers such as fluorine-containing comb-type graft copolymer resin, and polymers containing silicone. In the present invention in particular, when the photosensitive layer is directly formed on a conductive substrate of an aluminum raw drum without an intermediate underlayer, a filler material is contained in the layer in contact with the conductive substrate in both laminated type and single layer type photoconductors.

A protective layer 4 is provided as necessary for the purpose of improving durability for repeated printing. The protective layer is composed of a layer mainly of a resin binder, an inorganic thin film of amorphous carbon or amorphous silicon-carbon deposited by a vapor deposition technique, or a coating film of evaporated silica or alumina. The resin binder used for the protective layer can be the material used in the charge transport layer 3*b* or three-dimensionally cross-linked resin such as siloxane resin.

The thickness of the protective layer can be in an appropriate range in which the function of the photosensitive layer is not significantly degraded. A preferred range is generally 0.1 to 50 μm, more preferably 1 to 10 μm. The protective layer can be composed of plural layers.

Next, a detailed description of the production method of the invention will be given. The important point in the production method of the invention is to employ a conductive substrate of the aluminum cylindrical substrate with a nickel concentration of no more than 50 ppm by weight. Other processes in the production method can be conducted appropriately by techniques normally employed.

Figure 7:
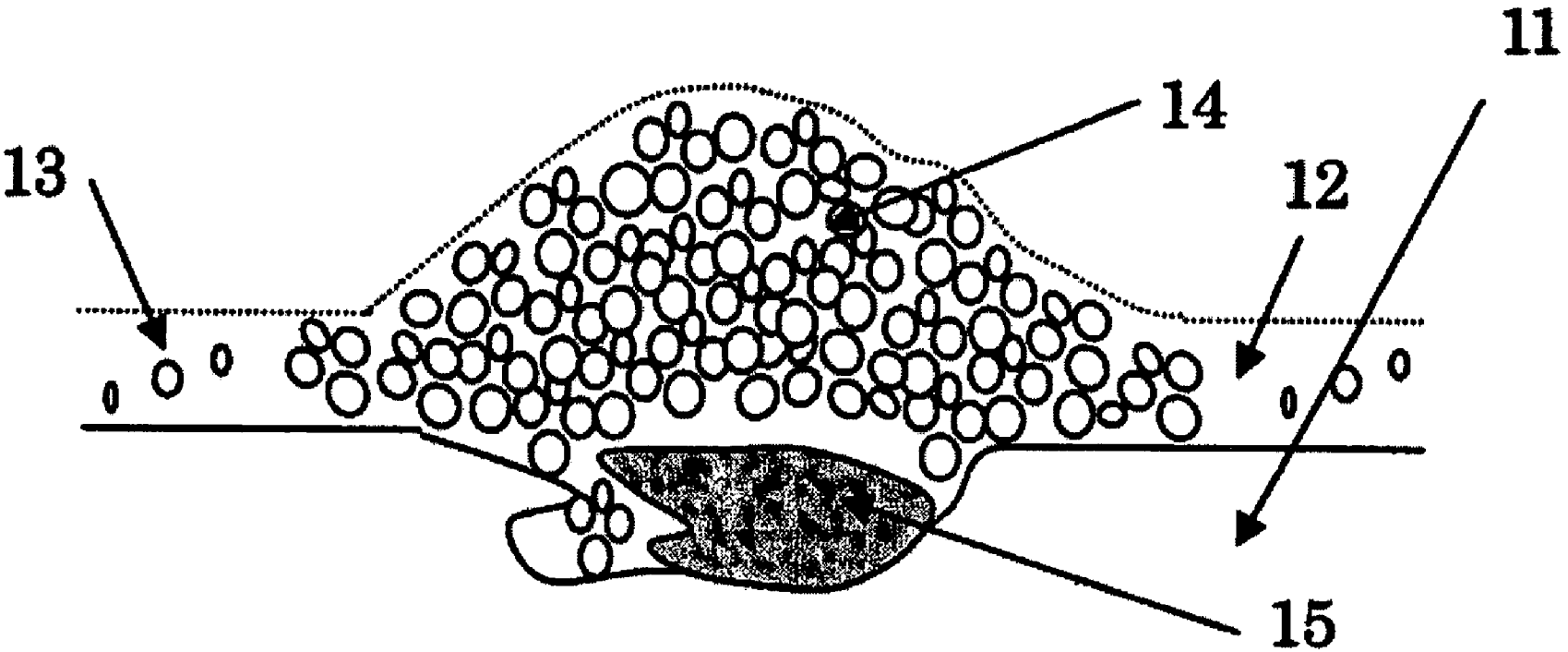
FIG. 7 shows schematically filler aggregation on an etching pit.
Figure 8A:
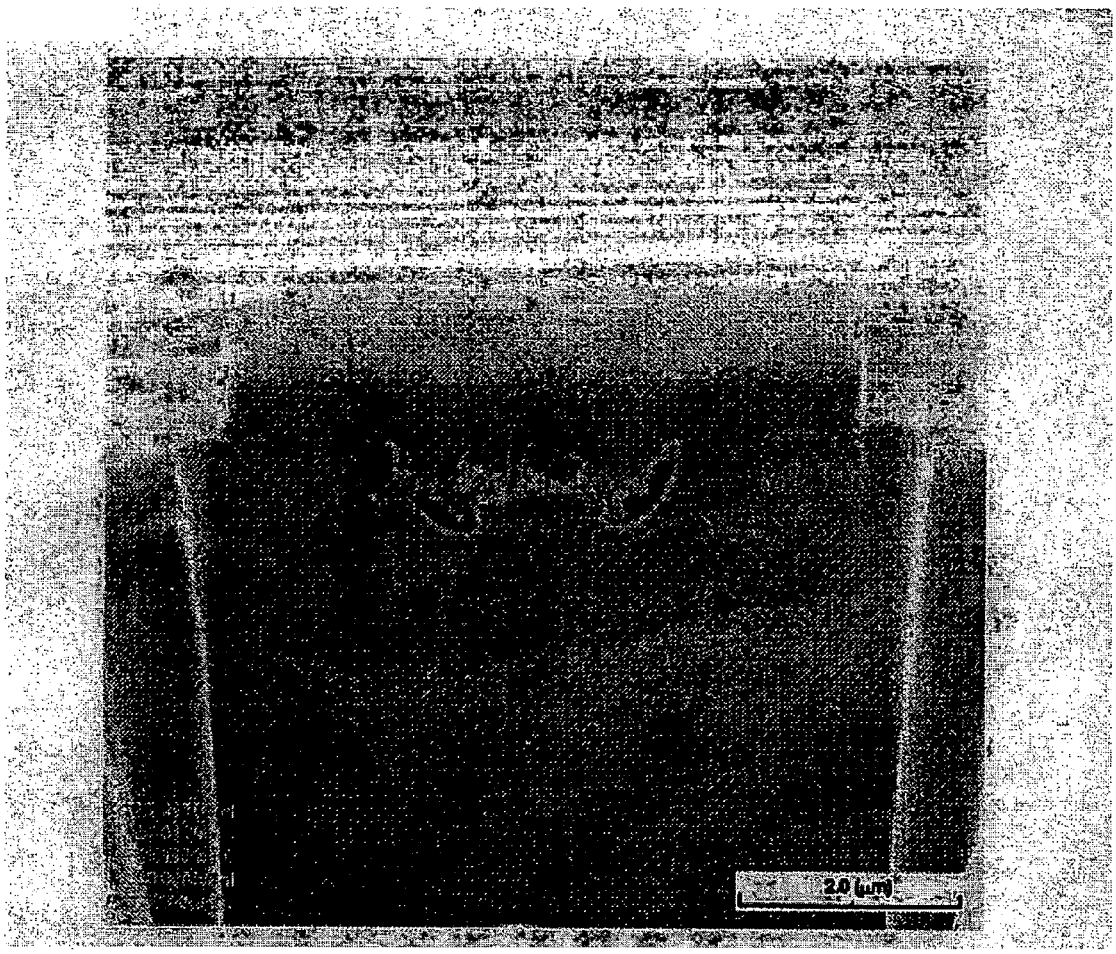
FIGS. 8A and 8B are photographs showing shapes of etching pits in the location of intermetallic compound not containing nickel more than a specified amount.
Figure 8B:
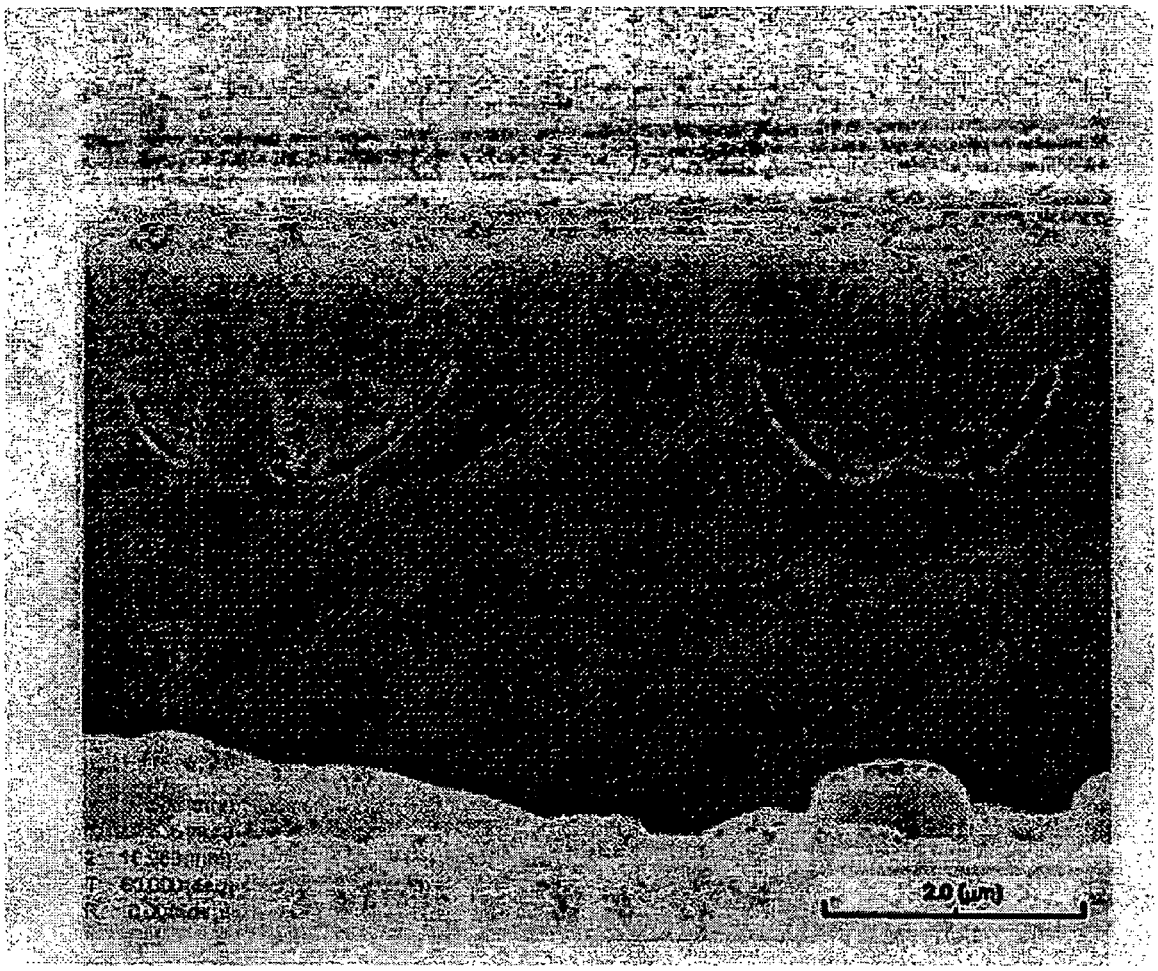
Figure 9A:
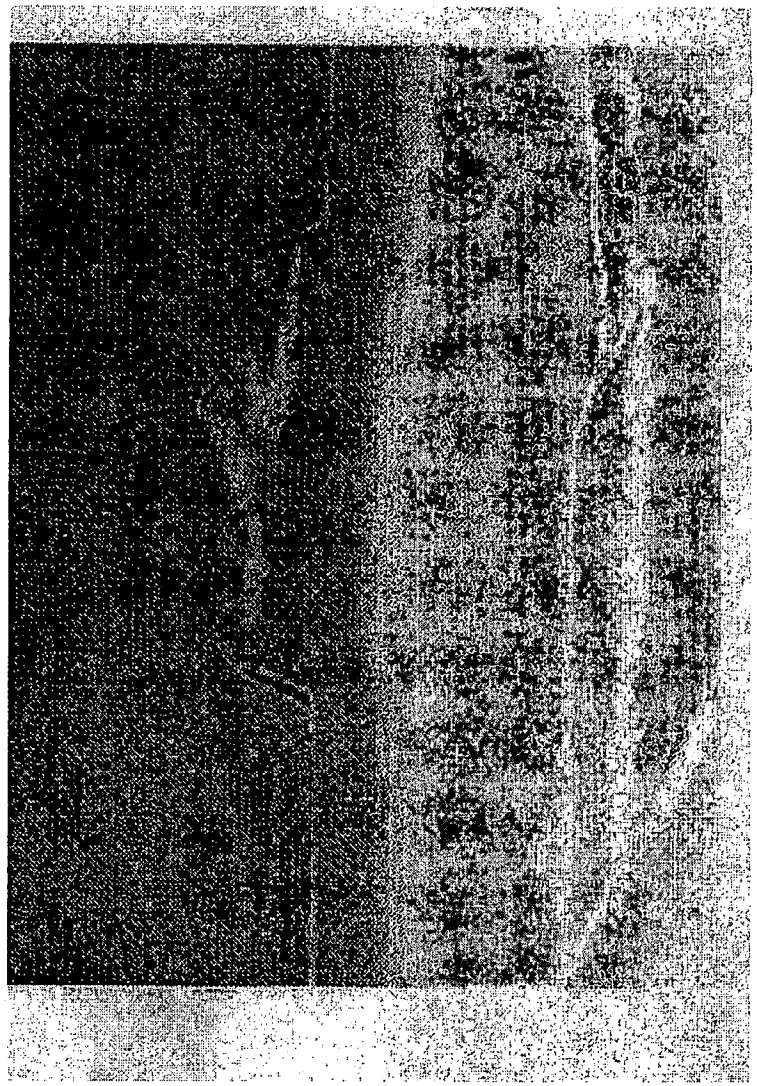
FIGS. 9A and 9B are photographs showing shapes of etching pits in the location of intermetallic compound containing nickel more than a specified amount.
Figure 9B:
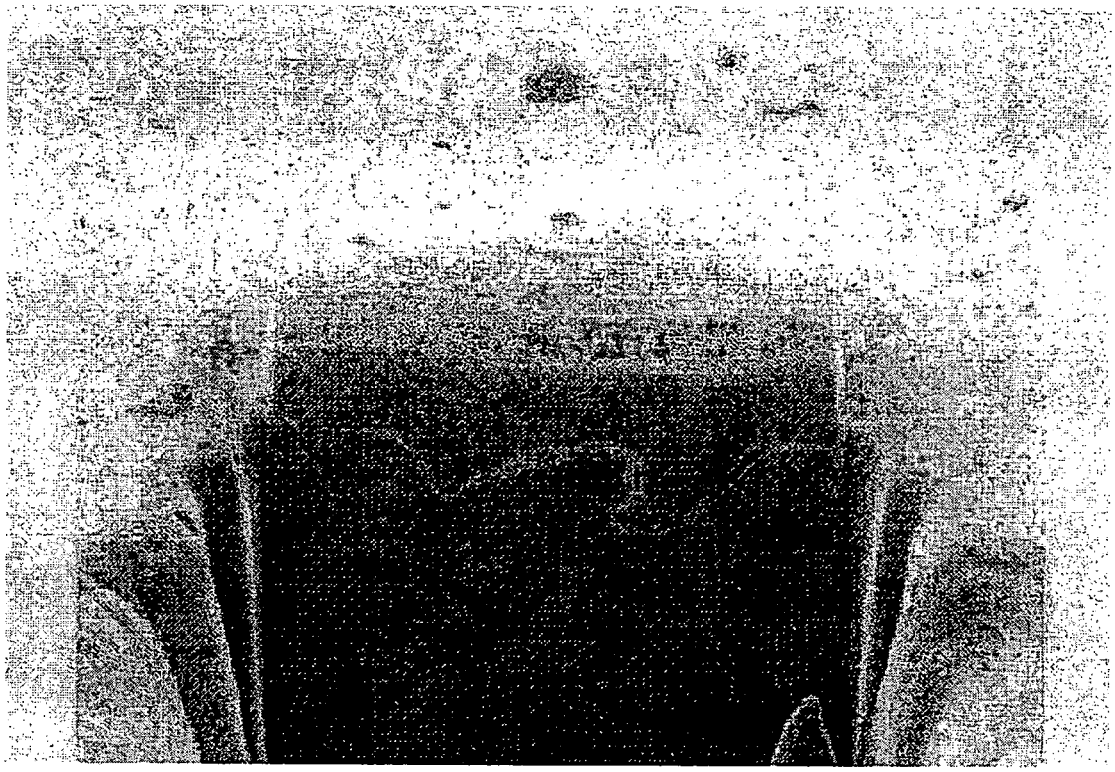
Figure 10B:
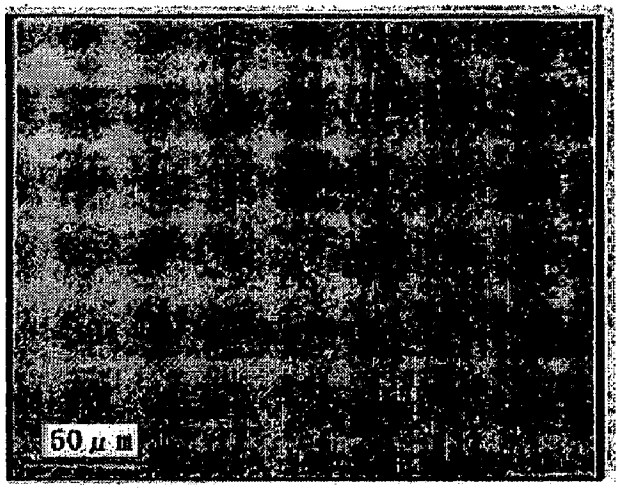
FIG. 10A through 10D are micrographs of surfaces of samples of aluminum substrate dipped in pure water at a measured temperature of 32° C. for 1, 2, 3, and 5 minutes.
Figure 10D:
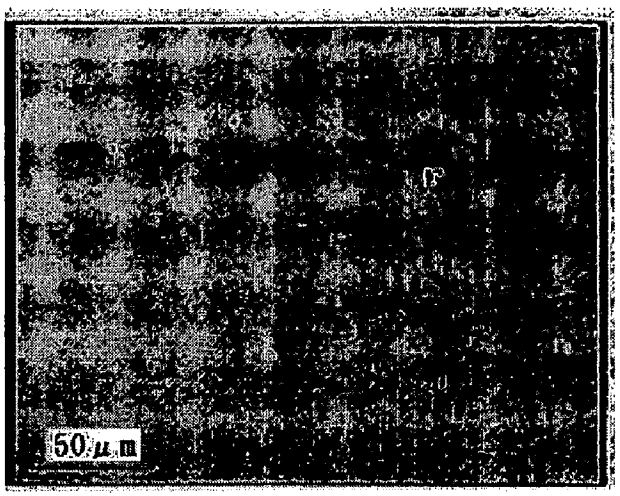
Figure 10A:
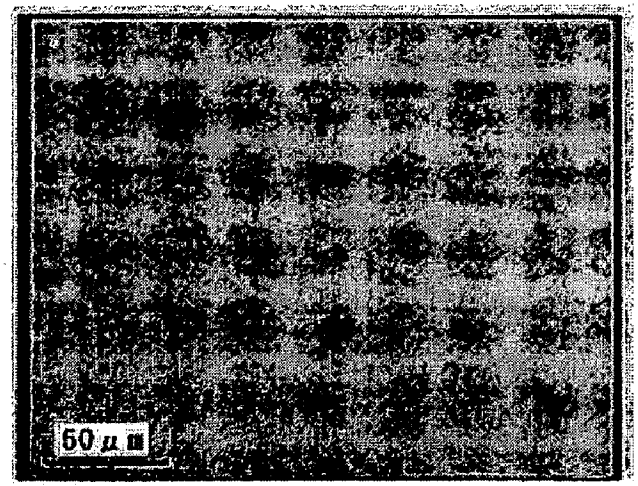
Figure 10C:
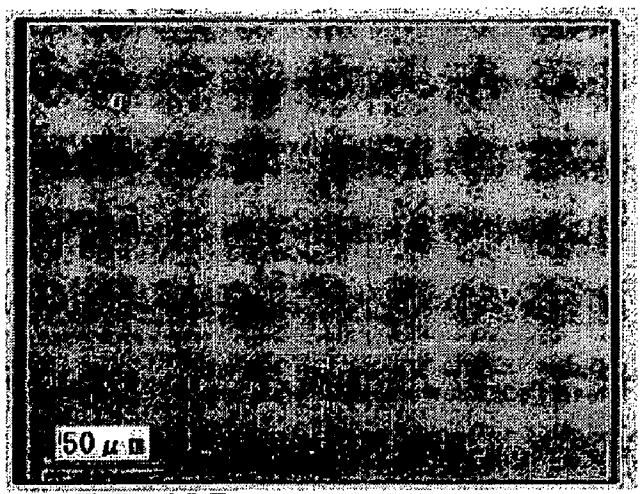
Figure 11B:
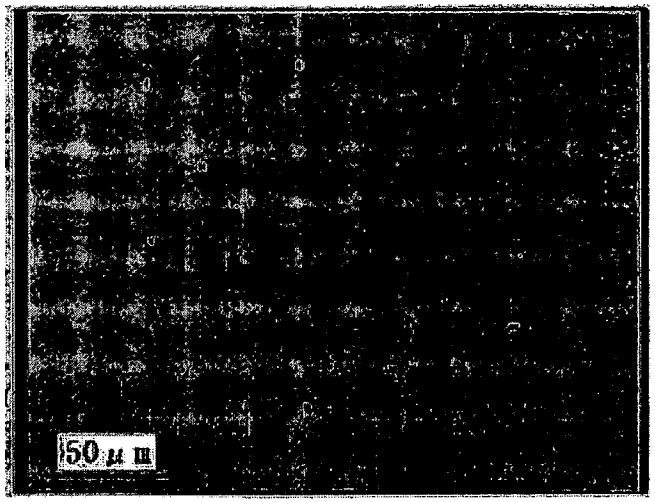
FIG. 11A through 11D are micrographs of surfaces of samples of aluminum substrate dipped in pure water at a measured temperature of 41° C. for 1, 2, 3, and 5 minutes.
Figure 11D:
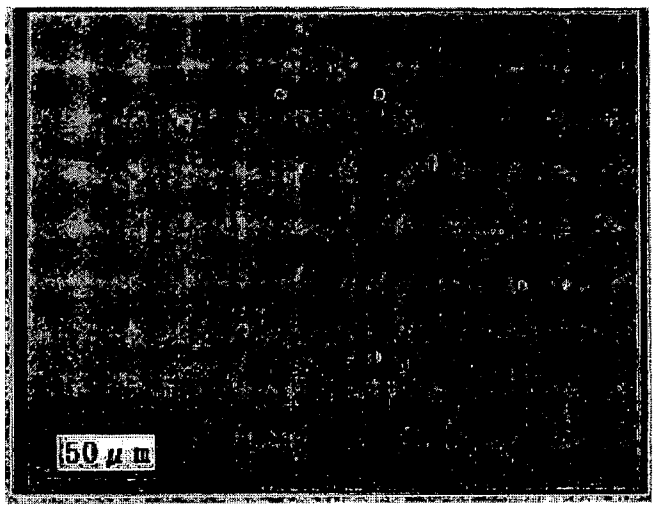
Figure 11A:
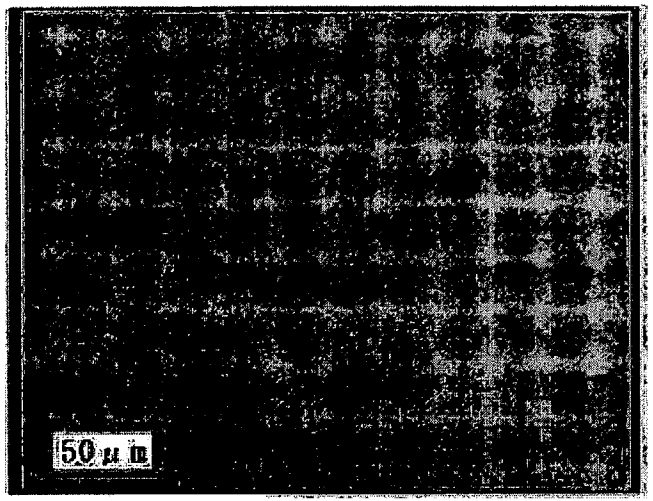
Figure 11C:
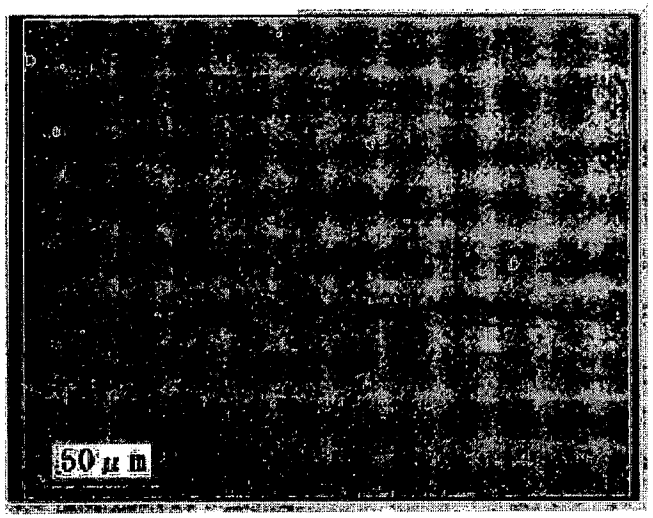
Figure 12A:
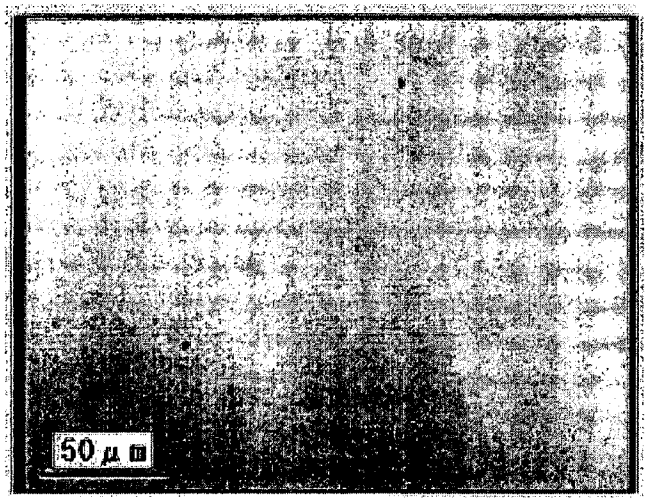
FIG. 12A through 12D are micrographs of surfaces of samples of aluminum substrate dipped in pure water at a measured temperature of 52° C. for 1, 2, 3, and 5 minutes.
Figure 12B:
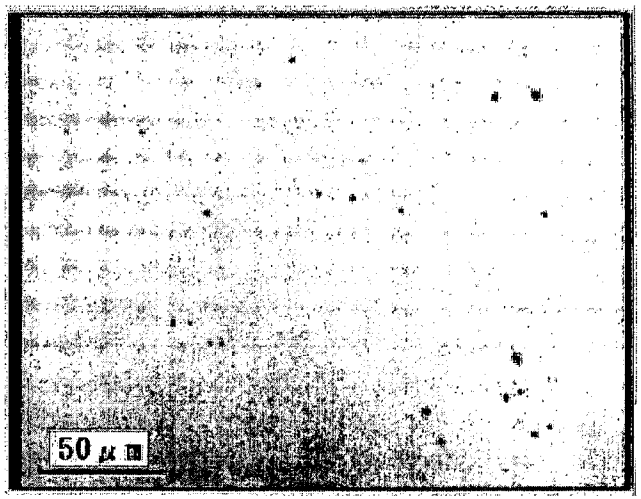
Figure 12C:
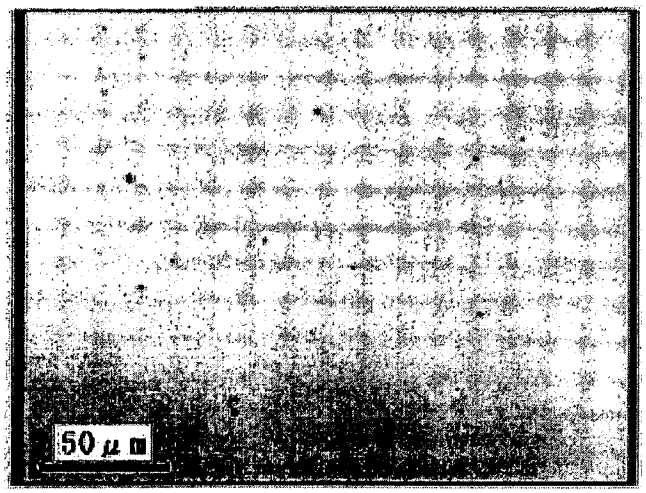
Figure 12D:
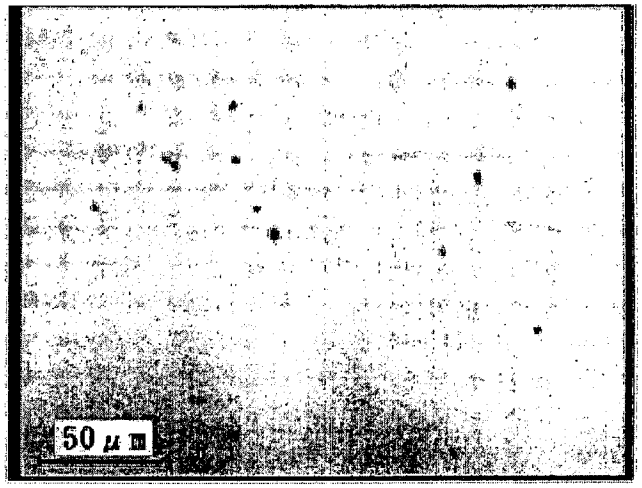
Figure 13A:
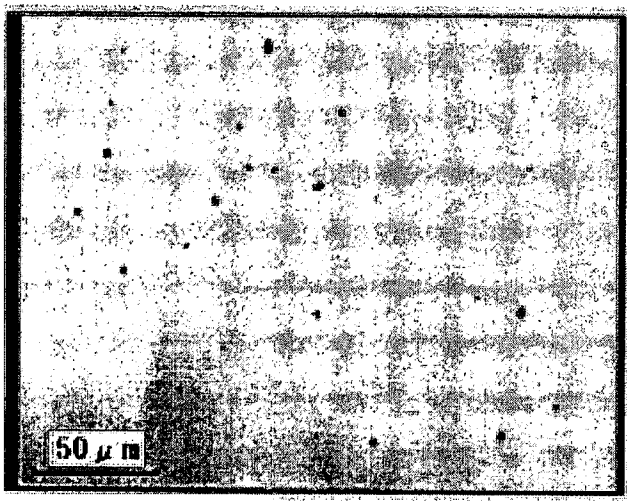
FIG. 13A through 13D are micrographs of surfaces of samples of aluminum substrate dipped in pure water at a measured temperature of 63° C. for 1, 2, 3, and 5 minutes.
Figure 13B:
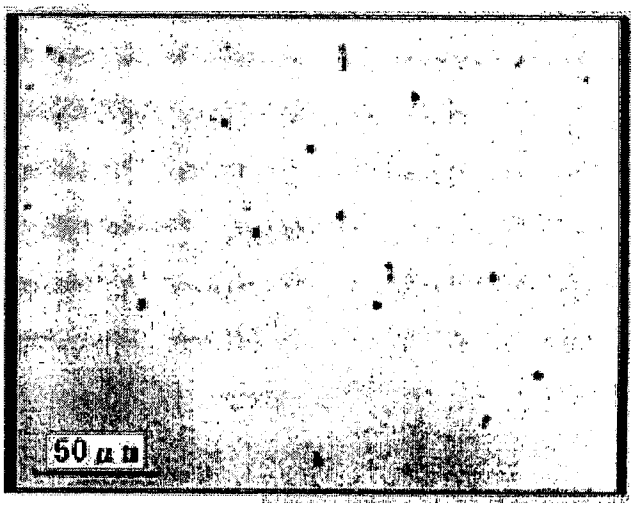
Figure 13C:
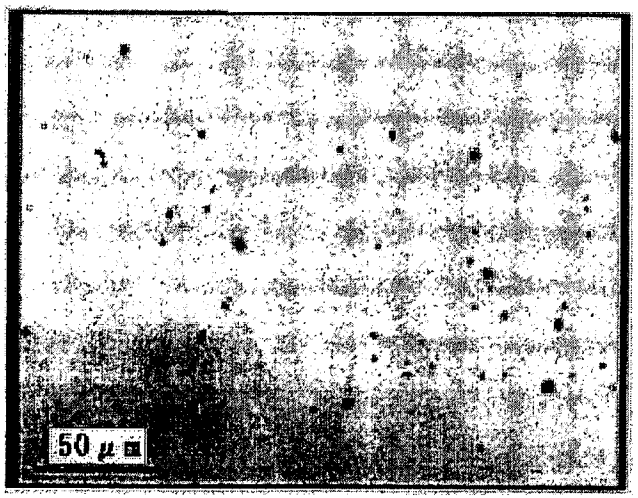
Figure 13D:
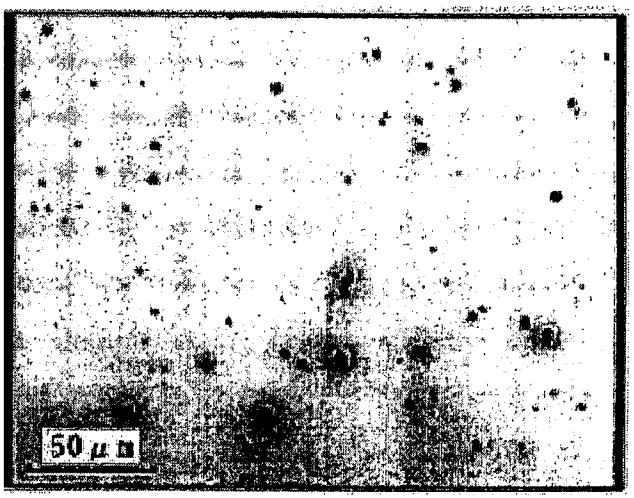

Specifically, the surface of the aluminum cylindrical substrate is first cut, and then degreased and cleaned using an aqueous cleaning agent. Though etching pits are formed around intermetallic compounds as mentioned previously, the etching pits have a simple hemispherical shape in the aluminum cylindrical substrate according to the invention, as shown in FIGS. 8A and 8B. As a result, the etching pits hardly retain water or the like, and thus, aggregation of filler material in the etching pits as shown in FIG. 7 scarcely occurs in the process of applying and forming a coating layer containing filler material on the aluminum raw drum after cleaning and drying. Printing defects are therefore avoided in the photoconductor in use.

In the production method of the invention, no special restriction is imposed on cutting conditions or actual cleaning process of the surface of the aluminum cylindrical substrate. An aqueous cleaning agent for use in the degreasing and cleaning process can be pure water consistent with the objective of the invention. So, the degreasing and cleaning process with an aqueous cleaning liquid can, for example, be a process of rinsing with pure water.

The coating layer containing filler material in the invention can be any layer that is formed on a conductive substrate of an aluminum cylindrical substrate. Specifically, the coating layer can be the undercoat layer 2 in the case of a photoconductor having a layer structure shown in FIGS. 1, 2, 4, and 5; the coating layer can be the single layer type photosensitive layer 3 in the case of a photoconductor having a layer structure as shown in FIG. 3; and the coating layer can be the charge transport layer 3*b* in a photoconductor having a layer structure as shown in FIG. 6.

The coating layer can be applied and formed by the following procedure for every layer mentioned above. A material composing the layer is dissolved and dispersed in an appropriate solvent to produce a coating liquid, which in turn is applied by an appropriate technique on the aluminum substrate that has been cleaned and dried, and then the solvent is removed by drying. Other sequentially laminated layers can be formed in a similar manner if the layer is formed by applying a coating liquid.

The solvent can be selected from alcohols such as methanol, ethanol, n-propanol, i-propanol, n-butanol or benzyl alcohol, ketones such as acetone, methylhexyl ketone (MEK), methyisobutyl ketone or cyclohexanone, amides such as dimethyl formamide (DMF) or dimethyl acetamide, sulfoxides such as dimethyl sulfoxide, cyclic or straight chain ethers such as tetrahydrofuran (THF), dioxane, dioxolane, diethyl ether, methylcellosolve or ethylcellosolve, esters such as methyl acetate, ethyl acetate or n-butyl acetate, aliphatic hydrocarbon halogenides such as methylene chloride, chloroform, carbon tetrachloride, dichloroethylene or trichloroethylene, mineral oils such as ligroine, aromatic hydrocarbons such as benzene, toluene or xylene, aromatic hydrocarbon halogenides such as chlorobenzene or dichlorobenzene, or a mixture of these substances.

The method of dissolving and dispersing the coating liquid can be selected from known methods using a paint shaker (paint conditioner), ball mill, bead mill (sand grinder) such as a dyno-mill, or ultrasonic dispersion. The method of applying the coating liquid can be selected from known methods including dip coating, ring coating (seal coating), spray coating, bar coating or blade coating.

The drying temperature and drying time in the drying process can be set considering the type of solvent and the production cost. The preferred drying temperature is in the range from room temperature to 200° C., and the preferred drying time is in the range from 10 minutes to 2 hours. The drying temperature is more preferably in the range between the boiling temperature of the solvent and the temperature of the boiling point plus 80° C. The drying process can be conducted generally at atmospheric pressure or at reduced pressure, and in stationary or blowing air.

A detailed method of producing a photoconductor is disclosed in, for example, an article in Proceedings of The Society for Electrophotography of Japan, Vol. 28, No. 2, pages 186-195 (1989) entitled "Production Techniques of OPC Photoconductors" (in Japanese).

EXAMPLES

The invention will be described in more detail referring to specific examples as follows.

Embodiment Example

An ingot with a nickel concentration of not more than 50 ppm was welded. (The measured concentration was 45 ppm, which was obtained according to the procedure described previously by means of ICP spectroscopy using JY138-ULTRACE, a product of Rigaku Corporation.) Adjusting silicon and magnesium content in the range of Si: 0.1 to 0.3 wt %, Mg: 0.4 to 0.8 wt %, the molten ingot was cast. The obtained aluminum alloy was hot extruded and cold drawn. The obtained drum was cut into a cylindrical shape having an outer diameter of 30 mm, inner diameter of 28.5 mm, and a length of 260 mm by ultrahigh precision lathe while spraying a mist of a cutting oil, more specifically electric discharge machinery oil (Metalwork ED, a product of Nippon Oil Corporation). The resulted drum was cleaned for 5 minutes using a neutral detergent (Elease EX1248/10% solution, pH=7.1, produced by Asahi Kasei Chemicals Corporation) warmed up to 50° C., and further cleaned by a rub cleaning technique for 2 minutes using alkaline detergent (No. 450/2% solution, pH=9.0, a product of BP Japan Inc.). After that, rinsing was conducted in pure water at 40° C. for 1, 2, 3, 4, and 5 min. After immersing in warm pure water at 60° C. for 2 min, each article was drawn up and air dried.

The surface of the raw drum in this condition was observed under an optical microscope at a multiplication of ×400, and the diameters of ten randomly selected etching pits were measured using a laser microscope (produced by Lasertec, Inc.)

A coating liquid was applied on the raw drum as cleaned by the above-described procedure, and an undercoat layer having a dried thickness of 3 to 4 μm was formed. The coating liquid was prepared by mixing and dissolving polyamide (CM8000, a product of Toray Industries Co., Ltd.), melamine resin (UVAN2020, a product of Mitsui Chemicals, Inc.), fine particles of titanium oxide ($TiO_2$, TAF-500T, a product of Fuji Titanium Industries Co., Ltd.), methanol (a product of Wako Pure Chemical Industries, Ltd.), n-butanol (a product of Wako Pure Chemical Industries, Ltd.), and dichloromethane (Methaclean S E, a product of Wako Pure Chemical Industries, Ltd.) in the proportions of 5.43 wt %, 1.36 wt %, 12.22 wt %, 24.3 wt %, 16.2 wt %, and 40.5 wt %, respectively. After drying at 140° C. for 30 min and cooling down to an ambient temperature, observation was carried out as to whether or not the $TiO_2$ aggregated at locations corresponding to etching pits.

The coating liquid for the undercoat layer was prepared by the following specific procedure.

First, 16,000 g of dichloromethane and 10,023 g of methanol were agitated and mixed. 2,255 g of polyamide resin, after stirring and swelling, was stirred and dissolved with this mixture. Next, 706 g of melamine resin and 800 g of dichloromethane were added, stirred in and dissolved. The obtained liquid was sequentially filtered with filters of 1 μm and then 0.2 μm. A weight of 7,978 (±80) g was measured out and 1,777 g of n-butanol was added followed by stirring and dissolving. Finally, 1,359 g of a mixture of two types of titanium oxide fine particles were mixed and dispersed by a dyno-mill under the conditions of 20 l/h and 10 passes. After passing through a sieve or filter to a measured grain size of below 250 nm, a coating liquid was obtained.

Comparative Example

An aluminum raw drum was produced in the same manner as in the Embodiment Example except that the ingot to be melted contained nickel in a concentration higher than 50 ppm. (The measured concentration was 60 ppm, which was obtained according to the procedure described previously, by means of ICP spectroscopy using JY138-ULTRACE, a product of Rigaku Corporation). On the obtained aluminum raw drum, diameters of etching pits were measured and observation was made whether $TiO_2$ aggregated or not after forming the undercoat layer. Results are given in Table 1.

TABLE 1

| | cleaning time (min) | diameter of etching pit (μm) | aggregation of $TiO_2$ |
|---|---|---|---|
| Example | 1 | 0.5-2.5 | none |
| Example | 2 | 1.2-2.9 | none |
| Example | 3 | 1.8-3.5 | none |
| Example | 4 | 2.5-4.0 | none |
| Example | 5 | 3.6-4.5 | none |
| Comp. Example | 1 | 0.7-2.7 | observed |
| Comp. Example | 2 | 1.0-2.6 | observed |
| Comp. Example | 3 | 1.8-3.7 | observed |
| Comp. Example | 4 | 2.4-4.3 | observed |
| Comp. Example | 5 | 3.8-4.7 | observed |

The observations on the surface of the undercoat layers formed in Examples and Comparative Examples as shown in Table 1 revealed that aggregation of $TiO_2$ was found in the etching pits in an aluminum alloy that contained nickel in more than 50 ppm, while this was not observed in the etching pits in an aluminum alloy that contained nickel in a concentration of not more than 50 ppm, irrespective of the size of the etching pit. Thus, the principle of the invention was confirmed that control of the shape of the etching pit, not the size of the etching pit, is effective for preventing aggregation of $TiO_2$.

Reference Example

Tests were also conducted as to whether etching pits were formed in pure water. An ingot with nickel concentration of more than 50 ppm was welded. (The measured concentration was 60 ppm, which was obtained according to the procedure described previously, by means of ICP spectroscopy using JY138-ULTRACE, a product of Rigaku Corporation.) The molten ingot was cast adjusting silicon and magnesium in the range of Si: 0.1 to 0.3 wt %, Mg: 0.4 to 0.8 wt %. The obtained aluminum alloy was hot extruded and cold drawn. The obtained drum was cut into a cylindrical shape having an outer diameter of 30 mm, an inner diameter of 28.5 mm, and a length of 260 mm by ultrahigh precision lathe, while spraying a mist of a cutting oil of electric discharge machinery oil (Metalwork E D, a product of Nippon Oil Corporation). Cutting was conducted to a mirror finishing to facilitate counting of etching pits by a laser microscope afterwards. Next, the drum was cut into pieces of 30 mm in length so as to make experiments in a beaker possible. Pure water was poured into the beaker and heated, and the samples were dipped in the pure water at 32° C., 41° C., 52° C., or 63° C. for 1, 2, 3, or 5 min.

Figure 14A:
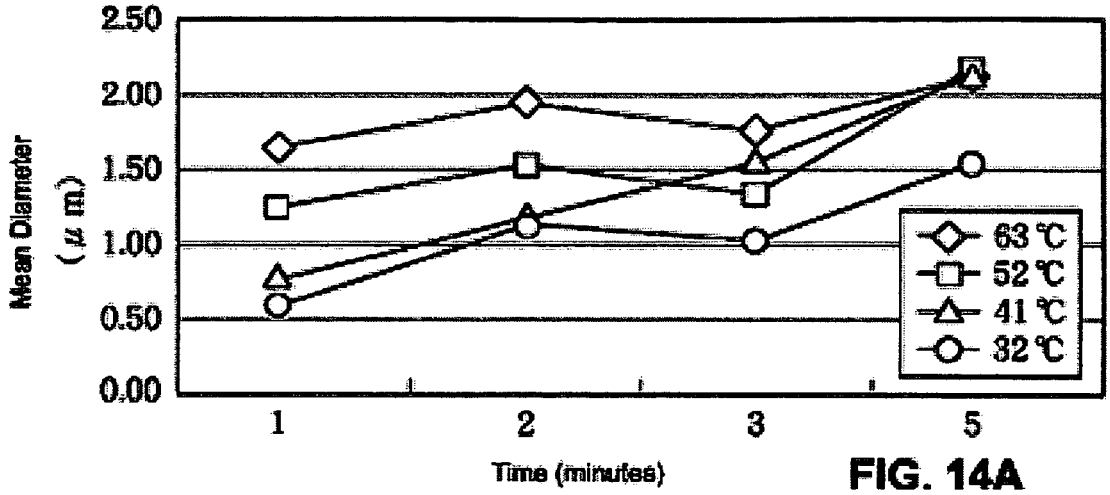
FIG. 14A through 14C are graphs showing measurement results of mean diameters, maximum diameters, and numbers of etching pits as functions of dipping time in the reference examples.
Figure 14B:
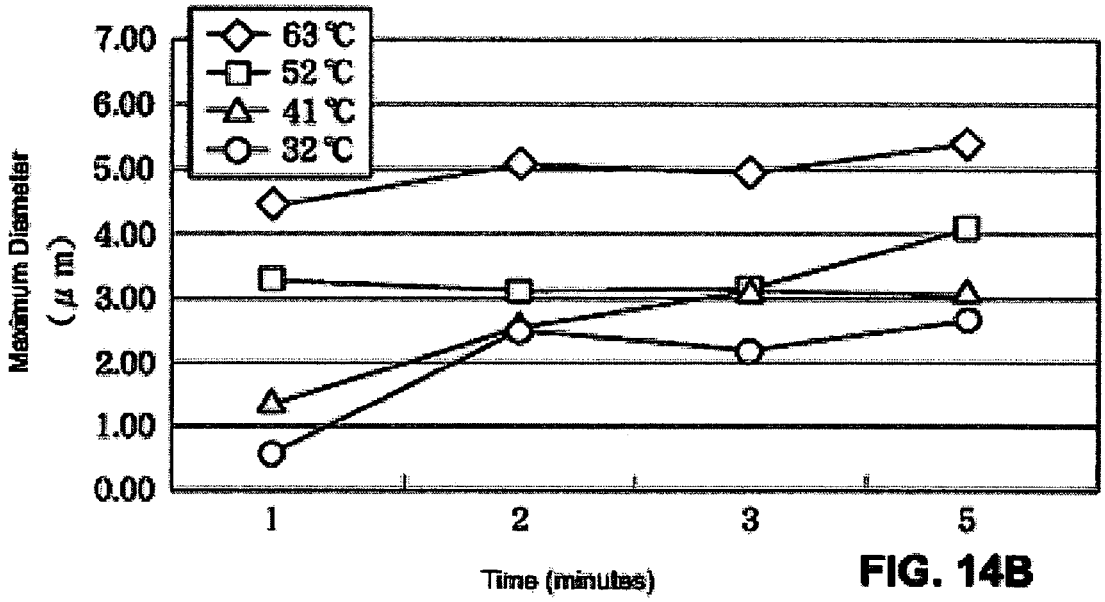
Figure 14C:
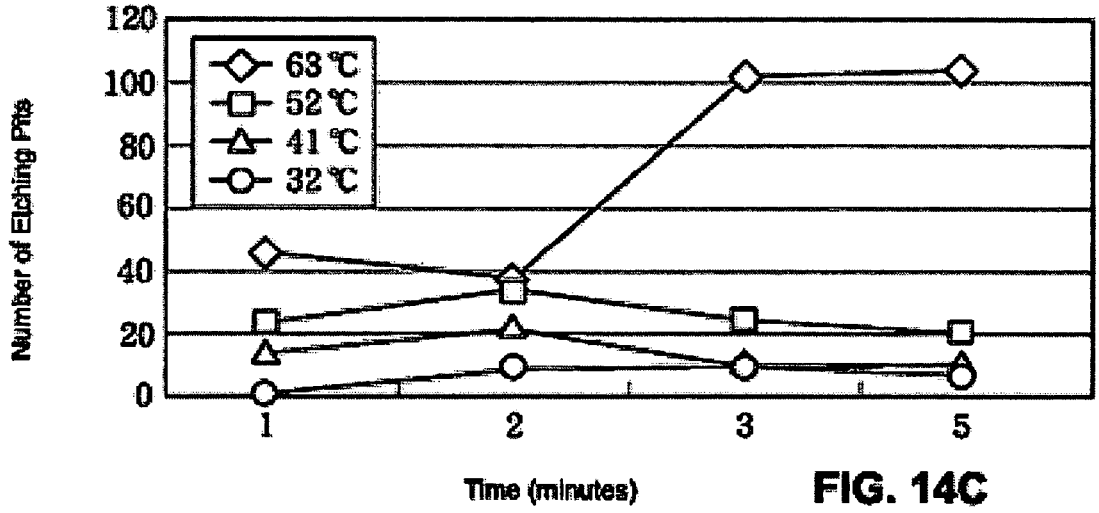

The obtained samples were observed under a laser microscope (produced by Lasertec, Inc.). FIGdS. 10A through 13D are the photographs taken. The obtained images were converted to binary data, and measurements were made on (1) mean diameter, (2) maximum diameter, and (3) number of pits, results of which are shown in FIGS. 14A, 14B, and 14C. It has been confirmed that even immersing in pure water at a temperature higher than 30° C. generates etching pits. FIG. 10A through 10D are photographs for pure water temperature of 32° C. taken after immersion for 1, 2, 3, and 5 min; FIG. 11A through 11D are for 41° C., FIG. 12A through 12D are for 52° C., and FIG. 13A through 13D are for 63° C.

Although specific examples have been provided above, the invention may of course be practice otherwise than as described without departing from the scope thereof.

What is claimed is:

1. A method of producing an electrophotographic photoconductor, comprising the steps of:

providing an aluminum cylindrical substrate, cutting a surface of the aluminum cylindrical substrate, degreasing and cleaning the surface of the aluminum cylindrical substrate with an aqueous cleaning agent after the cutting step, and applying and forming a coating layer containing a filler material on the aluminum cylindrical substrate after the degreasing and cleaning step, wherein a nickel concentration in the aluminum cylindrical substrate is at most 50 parts per million (ppm) by weight.

2. The method of producing an electrophotographic photoconductor according to claim 1, wherein the filler material is titanium oxide.

3. An electrophotographic photoconductor produced by the method of producing an electrophotographic photoconductor defined by claim 2.

4. An electrophotographic photoconductor produced by the method of producing an electrophotographic photoconductor defined by claim 1.

* * * * *